US007997788B2

(12) United States Patent
Bell et al.

(10) Patent No.: US 7,997,788 B2
(45) Date of Patent: Aug. 16, 2011

(54) SUBMERSIBLE MIXING PROPELLER

(75) Inventors: Jostein Bell, Surrey (CA); Jody Michael Bell, Surrey (CA)

(73) Assignee: Midan Industries Ltd., Langley, British Columbia (CA)

( * ) Notice: Subject to any disclaimer, the term of this patent is extended or adjusted under 35 U.S.C. 154(b) by 964 days.

(21) Appl. No.: 11/978,005

(22) Filed: Oct. 25, 2007

(65) Prior Publication Data

US 2009/0110559 A1 Apr. 30, 2009

(51) Int. Cl.
*B01F 7/22* (2006.01)

(52) U.S. Cl. ..... 366/164.3; 366/164.6; 261/87

(58) Field of Classification Search .... 366/164.2–164.6; 261/87

See application file for complete search history.

(56) References Cited

U.S. PATENT DOCUMENTS

| | | | | |
|---|---|---|---|---|
| 665,580 | A * | 1/1901 | Price | 366/328.2 |
| 780,260 | A * | 1/1905 | Beemer | 366/265 |
| 1,526,596 | A | 2/1925 | Greenawalt | |
| 3,210,053 | A | 10/1965 | Boester | |
| 3,490,996 | A | 1/1970 | Kelly, Jr. | |
| 3,864,438 | A | 2/1975 | Nagahama | |
| 4,297,214 | A | 10/1981 | Guamaschelli | |
| 5,160,459 | A | 11/1992 | Guamaschelli et al. | |
| 5,356,569 | A | 10/1994 | Von Berg | |
| 6,126,150 | A | 10/2000 | Van Dyk | |
| 6,394,430 | B1 | 5/2002 | Forschner et al. | |

FOREIGN PATENT DOCUMENTS

| | | |
|---|---|---|
| CA | 2102731 | 5/1994 |

OTHER PUBLICATIONS

Deshmukh et al Gas Induction Characteristics of Hollow Self-Inducing Impeller Feb. 2006 Institute of Chemical Engineers U.S.A.

* cited by examiner

*Primary Examiner* — David L Sorkin
(74) *Attorney, Agent, or Firm* — Klarquist Sparkman, LLP

(57) ABSTRACT

An aerating propeller for attaching to the end of a drive shaft includes blades having a chamber to receive a flow of fluids from a conduit in a drive shaft. A trailing face of the blade includes a first opening into the chamber to permit the flow of fluids in the chamber to exit the propeller and a tip of the blade includes a second opening extending into the chamber to permit the flow of fluids in the chamber to exit the propeller. The first opening of the first blade is aligned generally in the same plane with the leading face of the second blade which follows the first blade when the propeller is rotated.

23 Claims, 6 Drawing Sheets

SUBMERSIBLE MIXING PROPELLER

BACKGROUND OF THE INVENTION

This invention relates to a submersible mixing propeller used to introduce and mix a fluid (air, other suitable gasses and/or liquids) into liquids and to mix liquids and solids in those liquids.

Submersible mixing propellers are used as an aerator to aerate a liquid (that is introduce fine bubbles of air, or other gas, to intermix with the liquid) while simultaneously mixing the liquid with the air (or other gas) and also mixing the liquid (including solids suspended therein) into which the propeller is submerged. They are commonly used in industrial applications, including in waste water treatment plants to mix and aerate the waste liquids to facilitate digestion of waste in those liquids. It is important in achieving maximum efficiency of the digestion process to provide significant mixing of the waste water liquid and solids contained therein as well as to introduce air or other suitable gasses into the waste water in a manner which facilitates the mixing of the air or other suitable gasses with the waste water. Preferably the mixing propeller not only causes significant mixing of the liquids and solids, but also introduces the air and/or other suitable gases into the liquid in fine bubbles to assist in the absorption process with the liquid. The air and/or other suitable gasses suspended in the liquid is important as oxygen in the air or other suitable gasses is used by bacteria and other microscopic organisms in the process of digestion of the waste solids and decomposition of organic matter in the water in order to clean the water.

Such propellers can also be immersed into a first liquid and used to introduce and mix a second liquid into the first liquid. A mixture of air (or other gas) and a second liquid may also be introduced and mixed with the first liquid.

The application is also directed to a propeller that is suspended in a liquid to both mix that liquid and introduce fluids into the liquid in a manner which maximizes the absorption of the fluids into the liquid. The propeller is designed to provide both axial and radial flow to the liquid. Openings in the propeller for introducing fluid into the liquid are positioned optimally, as are the blades with respect to each other, to ensure the creation of fine bubbles of air or gas discharged into the liquid to physically contact the propeller as it spins. The shape of the blades of the propeller further assist in the mixing and aerating process undertaken by the propeller, the suction of fluid from the propeller openings into the liquid, and the axial and radial flow caused by rotation of the propeller.

It should be understood that while the term "air" is used in this description that term includes any other suitable gas or mixtures of gases as would be apparent to one skilled in the art. Similarly the use of the term "gas" includes air and any suitable mixtures of gases. The use of the term "fluid" means either a gas (including air), a liquid or a mixture of gas and liquid.

In an aspect of the invention a submersible mixing propeller for dispersing and mixing a fluid in a liquid, the propeller having an axis of rotation, includes an input for receiving a flow of fluid, first and second blades having a pressure side, suction side, tip, root section, leading face and a trailing face and a chamber communicating with the input for receiving the flow of fluid from the input. The trailing face comprises a first opening extending into the chamber to permit the flow of fluid in the chamber to exit the propeller. The tip comprises a second opening extending into the chamber to permit the flow of fluid in the chamber to exit the propeller. The suction side is angled from a plane perpendicular to the axis of rotation in a direction toward the pressure side when moving from the leading face to the trailing face. The first opening of the first blade is aligned generally in the same plane with the leading face of the second blade which follows the first blade, when the propeller is rotated.

In a further aspect of the invention the leading face is curved rearwardly along its length in a direction away from the direction of rotation of the propeller.

In another aspect the width of the leading face is greater than the width of the trailing face such that the pressure side and suction side are closer together at the trailing face as compared to the leading face.

Optionally, the pressure side is angled from a plane perpendicular to the axis of rotation in a direction toward the suction side when moving from the leading face to the trailing face. The angle of the suction side from the said plane may be greater than the angle of the pressure side from the said plane.

In a further embodiment the suction side is located at a lower region of the blade and is angled upwardly and the pressure side is located at an upper region of the blade and angled downwardly. The suction side may be located at an upper region of the blade angled downwardly and the pressure side may be located at a lower region of the blade angled upwardly.

In a further aspect of the invention the trailing face is curved rearwardly along its length in a direction away from the direction of rotation of the propeller and wherein the amount of curvature of the leading face is less than the amount of curvature of the trailing face such that the distance between the leading face and the trailing face is greater at the tip as compared to the root section of the blade.

In another embodiment the first opening of the first blade is configured to direct the flow of fluid from the chamber rearwardly in a direction away from the direction of rotation of the propeller to contact the leading edge of the second blade. Optionally, the second opening of the first blade is configured to direct the flow of air from the chamber radially and rearwardly to contact the leading edge of the second blade.

The number of blades may be four, oriented symmetrically about the axis of rotation.

In another embodiment the suction side is angled sufficiently to provide axial flow of the liquid when the propeller is rotated. The angle may between 5 degrees and 17 degrees from the said plane. The angle may be about 6.95 degrees from the said plane.

As a further embodiment the angle of the suction side from the said plane is greater than the angle of the pressure side from the said plane wherein the pressure side is angled sufficiently to provide axial flow of the liquid when the propeller is rotated. The angle may be between 1 degree and 10 degrees from the said plane. The angle may be about 1.30 degrees from the said plane.

In a further embodiment the plane defined by the leading face is oriented generally parallel with the axis of rotation of the propeller.

In another embodiment the plane defined by the trailing face is oriented generally parallel with the axis of rotation of the propeller.

In another embodiment the width of the blade between the leading face and the trailing face at the tip is greater than the width of the blade between the leading face and the trailing face at the root section.

In another embodiment an submersible mixing propeller adapted to be rotated about a central axis, includes an intake, a plurality of hollow propeller blades radially extending outwardly from the central axis and connected to the intake, the propeller blades having a pressure side, suction side, tip, root section, leading face and a trailing face. The pressure side is oriented at an angle from a plane perpendicular to the axis of rotation in a direction toward the suction side when moving from the leading face to the trailing face. The suction side is oriented at an angle from a plane perpendicular to the axis of rotation in a direction toward the pressure side when moving from the leading face to the trailing face. A first discharge opening in the trailing face and a second discharge opening in the tip are also provided. The trailing face of a first blade is aligned generally in the same plane with the leading face of the second blade which follows the first blade such that when the propeller is rotated in use liquid exiting the discharge opening of the first blade is struck by the leading edge of the second blade. The angled orientations of the pressure side and the suction side cause an axial flow of the water in which the propeller is submersed.

In a further embodiment of the invention a mixer for aerating and mixing a liquid includes a propeller, a shaft connected to the propeller, a motor connected to the shaft for imparting rotational force from the motor to the propeller through the shaft, a conduit in the shaft for transmitting a flow of gas to the propeller. The propeller includes at least one blade having a pressure side, suction side, tip, root section, leading face and a trailing face. The propeller includes a chamber connected to the conduit for receiving a flow of gas from the conduit. The trailing face includes a first opening extending into the chamber to permit the flow of gas in the chamber to exit the propeller. The tip includes a second opening extending into the chamber to permit the flow of gas in the chamber to exit the propeller. Optionally the shaft comprises an intake opening for receiving the flow of gas into the conduit in the shaft.

DETAILED DESCRIPTION

Figure 1:
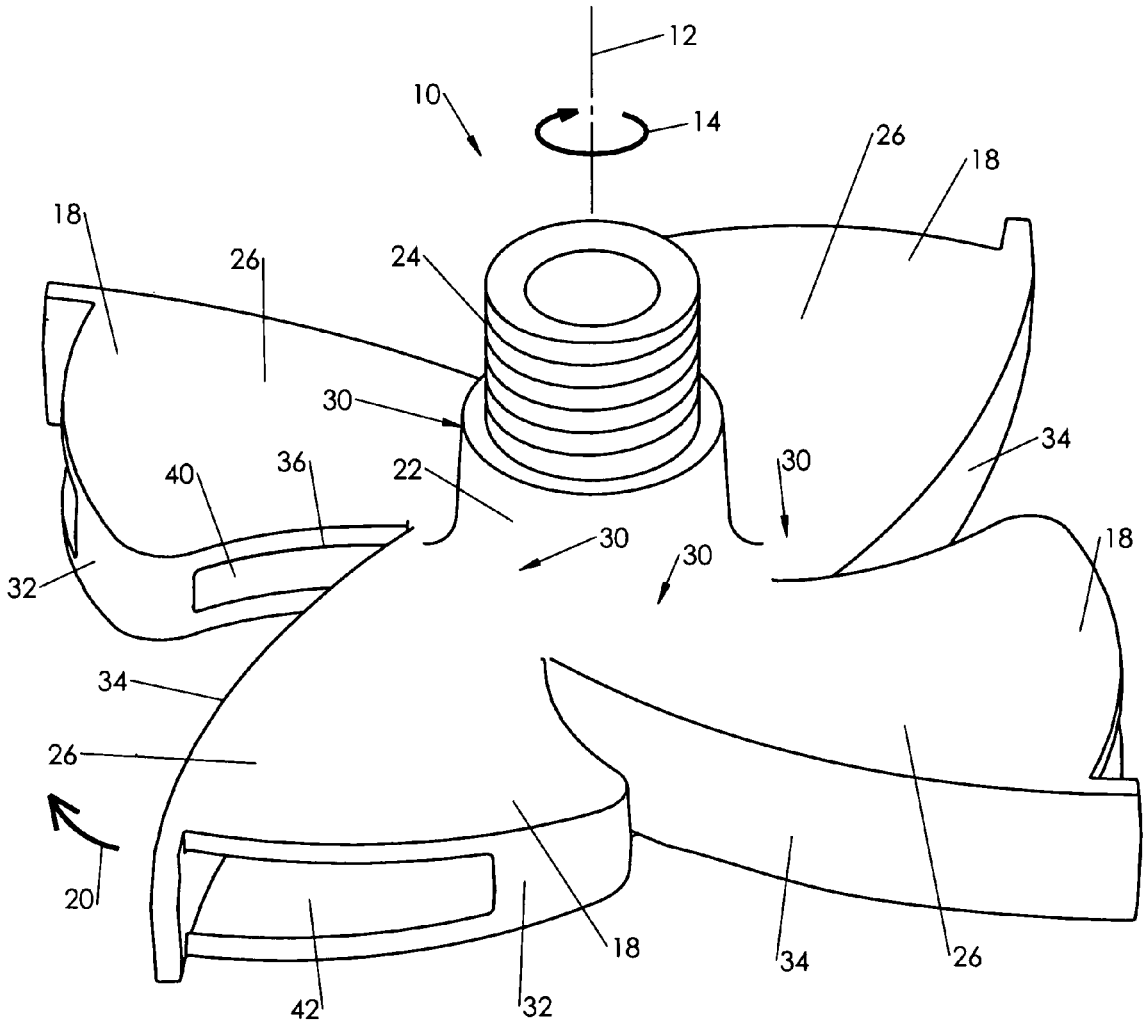
FIG. 1 is a top perspective view of the propeller of a preferred embodiment of the subject invention.
Figure 2:
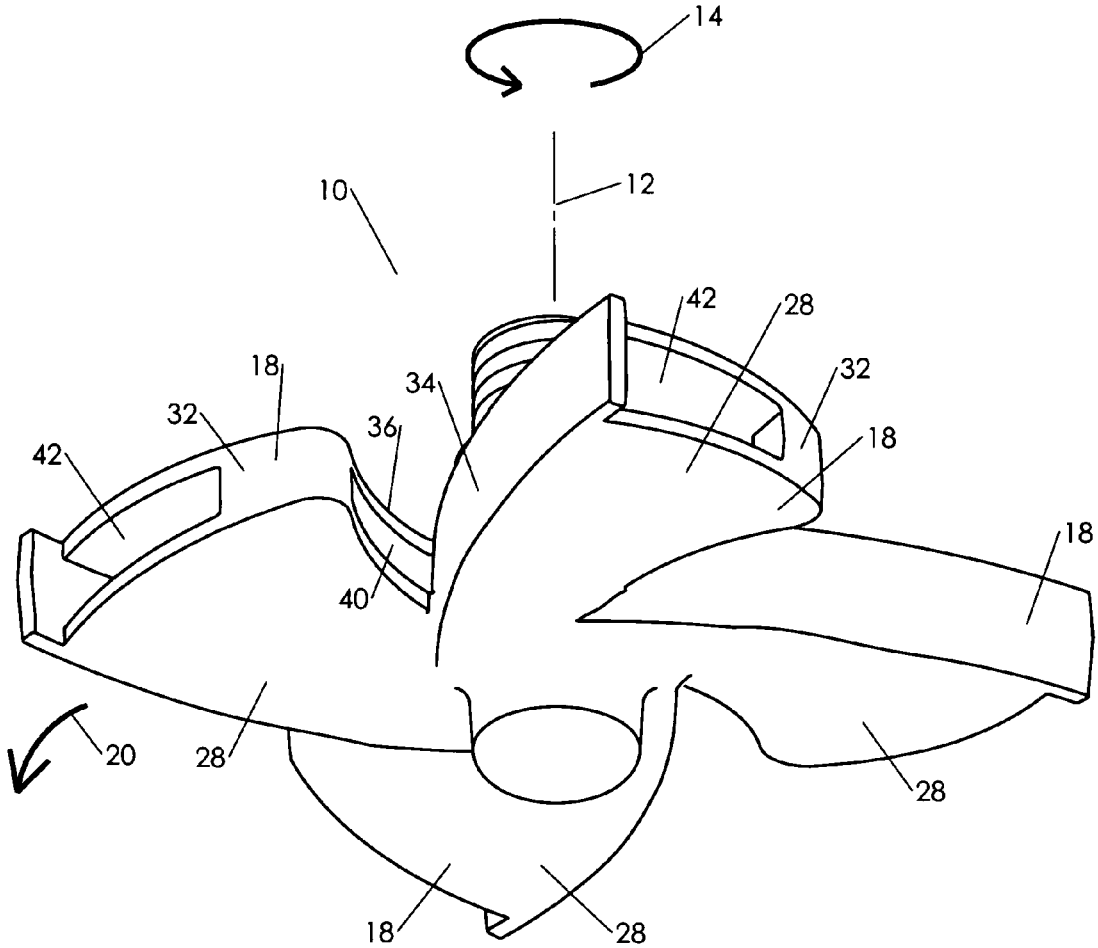
FIG. 2 is a bottom perspective view of the propeller of FIG. 1.

Referring to FIGS. 1 and 2, propeller 10 is shown in a top perspective view (FIG. 1) and a bottom perspective view (FIG. 2). Propeller 10 is designed to be attached to a shaft (not shown) at an end with the shaft attached to an appropriate motor to impart rotational motion on the shaft and propeller 10 about axis 12 in the direction of rotation 14. That is, to cause rotation of blades 18 in the direction of arrow 20.

Figure 3:
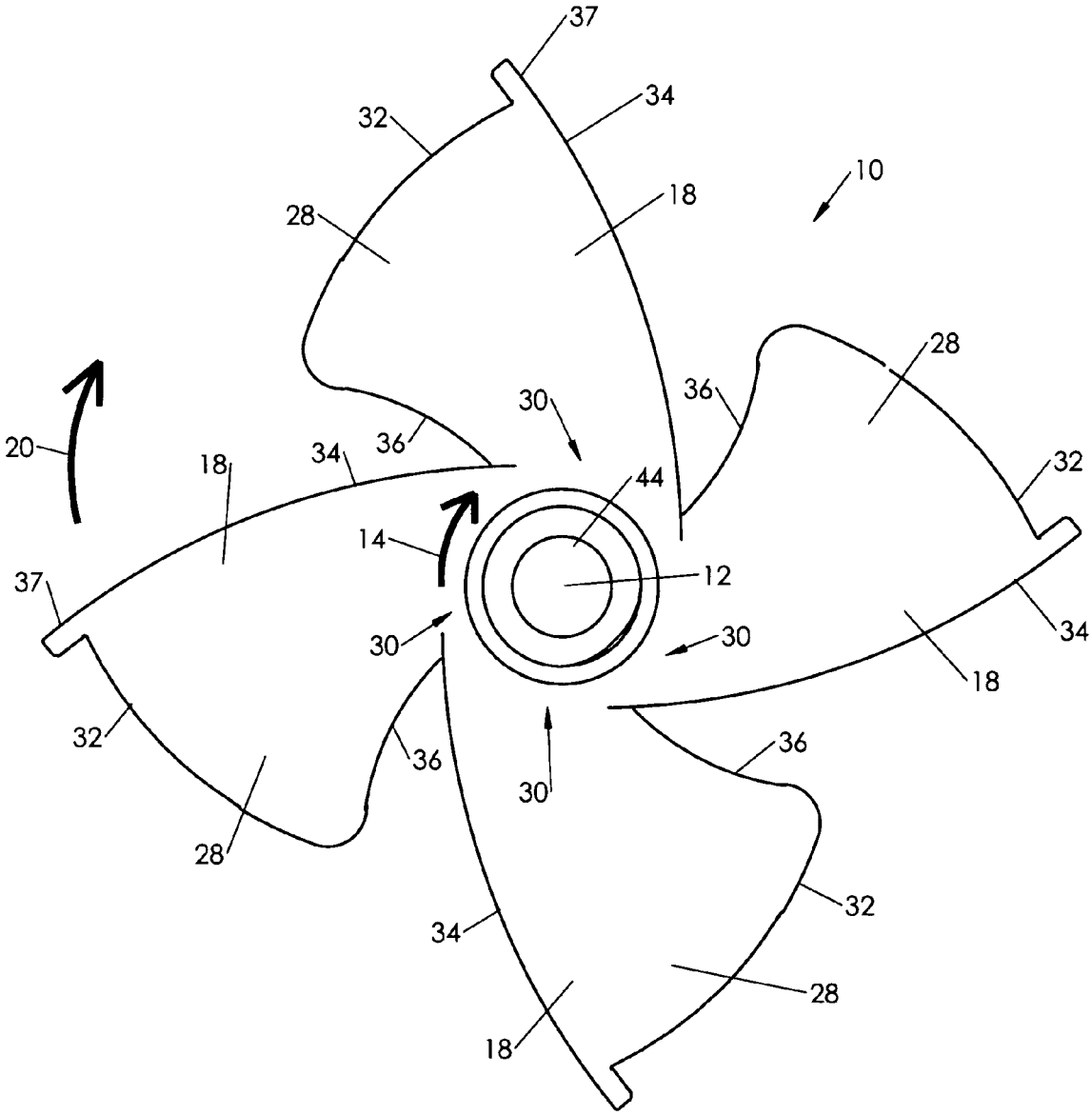
FIG. 3 is a top view of the propeller of FIG. 1.

Propeller 10 includes four lateral blades 18 arranged symmetrically about axis 12 as seen best in FIG. 3. When viewed from the side as in FIG. 4 blades 18 are generally perpendicular to axis 12, with some modification as discussed below.

Propeller 10 further includes upper extension 22 into which hollow threaded portion 24 is attached. Threaded portion 24 includes threads designed to mate with internal threads of the shaft (not shown) to attach propeller 10 through the shaft to a motor to rotate Propeller 10 in the direction of rotation 14.

Each blade 18 is comprised of upper surface or pressure side 26, lower surface or suction side 28, root section 30, tip 32, leading face 34 and trailing face 36.

Referring to FIG. 3, both leading face 34 and trailing face 36 are curved rearwardly in a direction away from the direction of rotation 14. It can be seen that the degree of curvature of leading face 34 is less than a degree of curvature of trailing face 36. This causes the distance between face 34 and face 36 to be less near root section 30, as compared to tip 32. This creates a relatively bulbous tip 32 of blade 18.

Leading face 34 includes outer extension 37 which extends outwardly beyond tip 32. Extension 37 is an optional component and provides additional impingement against the liquid and the fluid exiting from openings 40 and 42, as discussed below.

Figure 4:
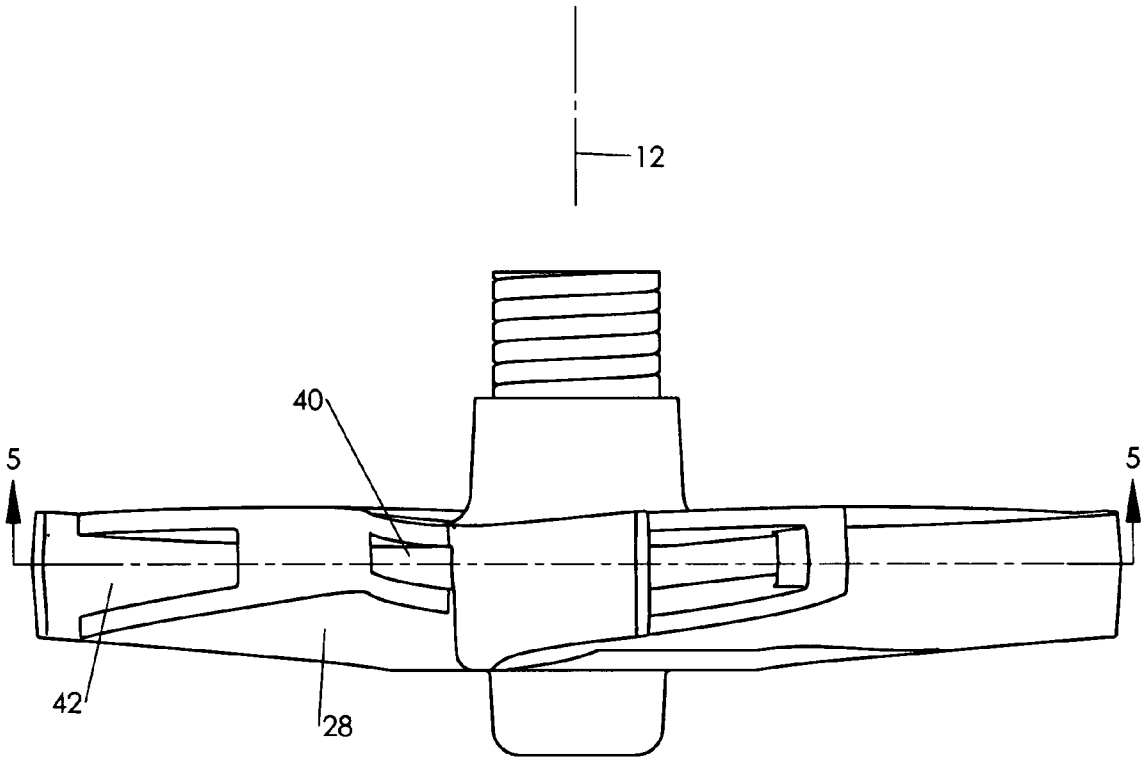
FIG. 4 is a side view of the propeller of FIG. 1.
Figure 6:
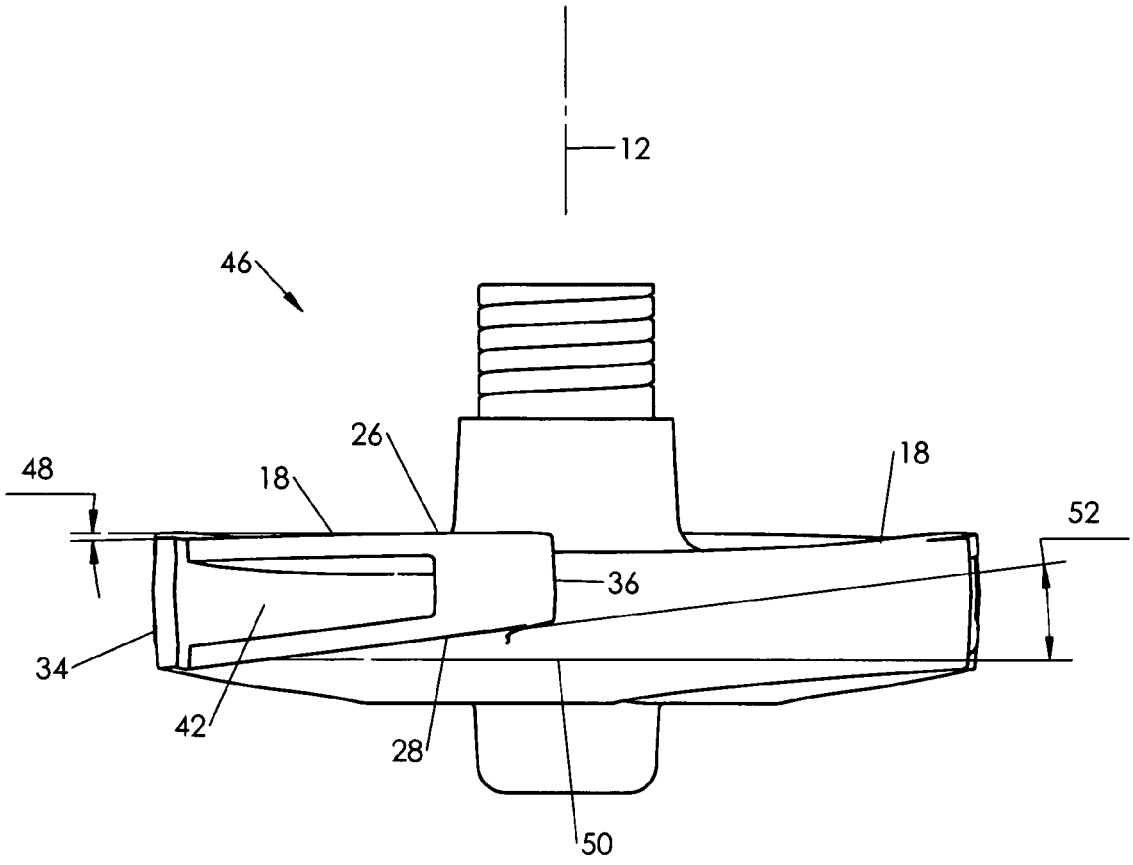
FIG. 6 is a side view of the propeller of FIG. 1.

Referring to FIGS. 4 and 6, upper surface (pressure side) 26 is angled upwardly from a plane 50 perpendicular to axis 12. This orientation of surface 26 means that upper surface (pressure side) 26 is lower adjacent leading face 34 as compared to trailing face 36. The preferred angle 48 between the plane perpendicular to axis 12 and the plane defined by upper surface (pressure side) 26 is about 1.30 degrees. Although a range of angles between about 1 and 10 degrees is also suitable.

Lower surface (suction side) 28 is also angled upwardly from a plane 50 perpendicular to axis 12. This orientation of surface 28 means that lower surface (suction side) 28 adjacent leading face 34 is lower than lower surface (suction side) 28 adjacent trailing face 36. The preferred angle 52 between plane 50 and the plane defined by lower surface (suction side) 28 is about 6.95 degrees. Although a range of angles between about 5 and 17 degrees is also suitable. In a preferred embodiment angle 48 of upper surface (pressure side) 26 is less than angle 52 of lower surface (suction side) 28.

In this embodiment the said angle of Lower surface (suction side) 28 is greater than the said angle of upper surface (pressure side) 26 which is a preferred orientation.

The orientation of upper surface (pressure side) 26 and lower surface (suction side) 28 in this manner, with angle 48 of upper surface (pressure side) 26 is less than angle 52, means that the distance between upper surface (pressure side) 26 and lower surface (suction side) 28 is less adjacent trailing face 36 as compared to the distance between upper surface (pressure side) 26 and lower surface (suction side) 28 adjacent leading face 34.

Figure 5:
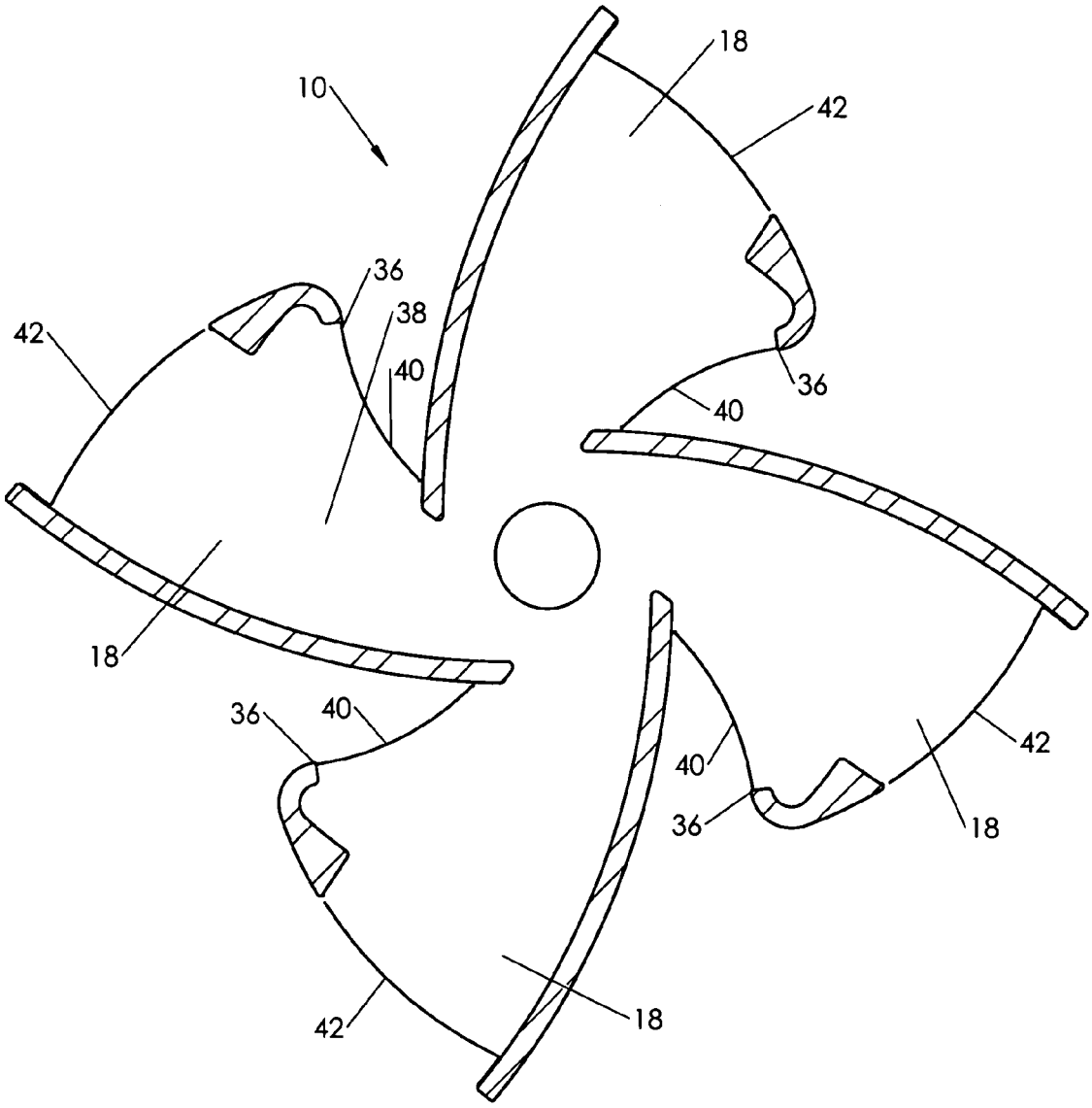
FIG. 5 is a cross-sectional view showing the outer periphery and internal chamber of the propeller of FIG. 1.

Referring to FIG. 5, each of blades 18 is hollow with chamber 38 extending Into and connecting with each blade 18 of propeller 10. Threaded portion 24 includes hollow channel 44 (FIG. 3) which is connected to channel 38. The shaft connecting threaded portion 24 with the drive motor likewise contains a hollow channel which connects to hollow channel 44. The opposite end of the drive shaft contains a plurality of openings which permit fluid to enter the hollow channel of the drive shaft and flow into chamber 38.

Each blade 18 includes two openings connected to chamber 38, a rearward opening or first opening 40 and an outer opening or second opening 42. Opening 40 is positioned within trailing face 36 and faces rearwardly toward the leading face of a blade 18 of propeller 10 to the rear of blade 18 containing a particular opening 40. Opening 40 is rectangular in shape positioned within trailing face 36 with an root section adjacent root section 30 of blade 18.

Opening 42 is positioned within tip 32 facing outwardly from axis 12. Opening 42 is positioned within tip 32 adjacent leading face 34 at one end and with its opposite end near trailing face 36. Opening 42 is generally rectangular in shape, although due to the angling of upper and lower surface (suction side)s 26 and 28 as discussed above, opening 42 is somewhat wider at its end adjacent leading face 34 as compared to its opposite end.

Operation

Propeller 10 is designed to be immersed in a liquid to provide both mixing of the liquid and aerating of the liquid, that is introducing air into the liquid. One useful application is in the mixing and aeration of municipal waste tanks to enhance the breakdown of organic waste by bacteria which need the oxygen in the introduced air to properly digest that material and to multiply, although the submersible mixing propeller can be used to introduce and mix various fluids in a liquid in which the propeller is submerged.

As discussed above, propeller 10 is designed to be rotated in the direction of arrow 20. A suitable motor (not shown) is connected to propeller 10 by means of a drive shaft, also not shown. The drive shaft is hollow with the hollow opening connected to the hollow channel 44 which, in turn, is connected to chamber 38.

Upon rotation of propeller 10, fluid (in the case of aeration, the fluid is air) is either forced down or drawn down the hollow interior of the drive shaft into channel 44 and then into chamber 38. Due to the centrifugal forces on the fluid within propeller 10 as it rotates, the fluid in chambers 38 of each blade 18 is forced out of openings 40 and 42. Fluid exiting chamber 38 through opening 40 exits rearwardly striking the leading face 34 of blade 18 (including optional extension 37 if utilised) which follows the blade 18 of that particular opening 40. That leading face 34 (and optional extension 37) contacts the fluid exiting opening 40 which splits the fluid into fine bubbles to assist in dispersing the fluid in the liquid in which propeller 10 is immersed.

Fluid exiting chamber 38 through opening 42 is flung outwardly into the liquid generally in a lateral direction perpendicular to axis 12. Fluid exiting chamber 38 through opening 42 is thereby widely dispersed away from propeller 10 with a portion of the fluid being struck by leading face 34 (and optional extension 37 if utilised) of blade 18 following that opening 42 further facilitating the dispersal of the fluid from chamber 38 through opening 42 in a wide direction away from propeller 10.

As propeller 10 rotates in the direction of arrow 20, the angle of upper surface (pressure side) 26 creates an additional physical contact with the liquid, in addition to the contact caused by leading face 34. The contact of upper surface (pressure side) 26 with the liquid causes the liquid to flow axially in a direction generally parallel with that of axis 12, in an upward direction.

The angle of lower surface (suction side) 28 creates a suction beneath blades 18 as propeller 10 is rotated in the direction of arrow 20, which sucks the liquid along lower surface (suction side) 28 in a direction from an area adjacent leading face 34 toward and past trailing face 36 which also causes the liquid to move generally axially in a direction perpendicular to axis 12 and upwardly from propeller 10. This also provides thrust which makes propeller 10 run more smoothly.

The upward movement of the liquid past propeller 10 acts to mix the liquids and also to facilitate mixing of the fluid with the liquid as the liquid is drawn past propeller 10 as fluid is leaving propeller 10 through openings 40 and 42.

Fluid exiting openings 40 and 42 moves generally in a lateral direction causing mixing of liquid located generally laterally of propeller 10, that is perpendicular to axis 12. On the other hand, the angles of upper surface (pressure side) 26 and lower surface (suction side) 28 cause an upward movement of liquid as propeller 10 is rotated. This simultaneous lateral mixing (i.e. radial mixing) and upward mixing (i.e. axial mixing) provides significant benefits as compared to propellers which mix liquid in only one direction, either radially or axially. Mixing is further enhanced due to the positioning of opening 40 with respect to leading face 34 of the following blade 18 which causes fluid leaving opening 40 to be struck by leading face 34 to further enhance the mixing process of fluid in the liquid further enhancing the operation of propeller 10 to aerate that liquid.

Also beneficial to the mixing of the liquid and mixing of the liquid with the fluid is the curvature of leading face 34, which is curved rearwardly in a direction away from the direction of rotation 14. Furthermore, blades 18 at their tip are wider than at their root section to form a bulbous tip. As propeller 10 turns in the direction of arrow 14, the liquid accelerates across leading edge 34 creating an area of high pressure in front of and on top of each blade 18. The curvature of leading edge 34 accelerates the liquid along leading edge 34 outwardly toward extension 37. Liquid is also accelerated across upper surface (pressure side) 26 and lower surface (suction side) 28 of each blade 18 toward tip 32 of each blade 18.

This high pressure stream of liquid accelerates across openings 40 and 42 to create a low or negative pressure area within chamber 38. That negative pressure draws fluid down the hollow shaft into chamber 38 and the fluid is then flung outwardly by centrifugal force due to the rotation of propeller 10. The fluid leaving openings 40 and 42 are sheared by the blade 18 immediately behind the openings 40 and 42 through which the fluid exists. The fluid leaving opening 40 is sheared by extension 37 and the outer portion of leading face 34 whereas the fluid leaving opening 40 is sheared by the inner part of leading face 34. This creates very fine bubbles of fluid leaving these openings 40 and 42 for improved oxygen absorption into the liquid.

It should further be noted that the combination of the perpendicular, relatively blunt, configuration of leading face 34, the generally bulbous tip 32 of blades 18 and the curvature rearwardly of leading face 34 cause the liquid in which the propeller is submerged to travel across blades 18 and along leading face 34 in a manner which creates streams of higher pressure of the liquid in front of and on top of each blade 18. The higher pressure streams of liquid flows past openings 40 and 42 as propeller 10 is rotated in the direction of arrow 14. This creates a region of lower pressure within chamber 38 which draws the fluid down the hollow shaft (not shown) through chamber 38 and out openings 40 and 42 into the liquid. This facilitates the dispersing and mixing of the fluid with the liquid.

Alternatives

An alternative preferred embodiment provides an opposite axial flow as compared to the embodiment discussed above. In this embodiment the suction side of blade 18 is oriented in a similar manner, with a similar angle from a plane perpendicular to the axis of rotation of the propeller of this embodiment, as with lower surface (suction side) 28 of the previous embodiment, although instead of being located on the lower side of blade 18 suction side is located on the upper side of blade 18. The suction side in this embodiment is angled downwardly from a plane perpendicular to the axis of rotation of the propeller of this embodiment.

Similarly the positioning of the pressure side is reversed from that of the above embodiment. The pressure side of blade 18 is oriented in a similar manner, with a similar angle from a plane perpendicular to the axis of rotation of the propeller of this embodiment, as with upper surface (pressured side) 26 of the previous embodiment, although instead of being located on the upper side of blade 18 pressure side is located on the lower side of blade 18. The pressure side in this embodiment is angled upwardly from a plane perpendicular to the axis of rotation of the propeller of this embodiment.

This causes an axial flow of the liquid in which the propeller of this embodiment is submerged in a downward direct from the propeller, rather than the upward direction of the previous embodiment.

As will be apparent to those skilled in the art to which the invention is addressed, the present invention may be embodied in forms other than those specifically disclosed above, without departing from the spirit or essential characteristics of the invention. The particular embodiments of the invention described above and the particular details of the processes described are therefore to be considered in all respects as illustrative or exemplary only and not restrictive. The scope of the present invention is as set forth in the complete disclosure rather than being limited to the examples set forth in the foregoing description.

The invention claimed is:

1. A submersible mixing propeller for dispersing and mixing a fluid in a liquid, the propeller having an axis of rotation, comprising:

(a) an input for receiving a flow of fluid;

(b) first and second blades having a pressure side, suction side, tip, root section, leading face and a trailing face, (c) a chamber communicating with the input for receiving the flow of fluid from the input;

(d) the trailing face comprises a first opening extending into the chamber to permit the flow of fluid in the chamber to exit the propeller;

(e) the tip comprises a second opening extending into the chamber to permit the flow of fluid in the chamber to exit the propeller;

(f) the suction side is angled from a plane perpendicular to the axis of rotation in a direction toward the pressure side when moving from the leading face to the trailing face; and wherein the first opening of the first blade is aligned generally in the same plane with the leading face of the second blade which follows the first blade, when the propeller is rotated.

2. The propeller of claim 1 wherein the leading face is curved rearwardly along its length in a direction away from the direction of rotation of the propeller.

3. The propeller of claim 1 wherein the width of the leading face is greater than the width of the trailing face such that the pressure side and suction side are closer together at the trailing face as compared to the leading face.

4. The propeller of claim 1 wherein the pressure side is angled from a plane perpendicular to the axis of rotation in a direction toward the suction side when moving from the leading face to the trailing face.

5. The propeller of claim 4 wherein the angle of the suction side from the said plane is greater than the angle of the pressure side from the said plane.

6. The propeller of claim 5 wherein the suction side is located at a lower region of the blade and is angled upwardly and the pressure side is located at an upper region of the blade and angled downwardly.

7. The propeller of claim 5 wherein the suction side is located at an upper region of the blade and is angled downwardly and the pressure side is located at a lower region of the blade and angled upwardly.

8. The propeller of claim 2 wherein the trailing face is curved rearwardly along its length in a direction away from the direction of rotation of the propeller.

9. The propeller of claim 8 wherein the amount of curvature of the leading face is less than the amount of curvature of the trailing face such that the distance between the leading face and the trailing face is greater at the tip as compared to the root section of the blade.

10. The propeller of claim 3 wherein the trailing face is curved rearwardly along its length in a direction away from the direction of rotation of the propeller and wherein the amount of curvature of the leading face is less than the amount of curvature of the trailing face such that the distance between the leading face and the trailing face is greater at the tip as compared to the root section of the blade.

11. The propeller of claim 8 wherein the first opening of the first blade is configured to direct the flow of fluid from the chamber rearwardly in a direction away from the direction of rotation of the propeller to contact the leading edge of the second blade.

12. The propeller of claim 11 wherein the second opening of the first blade is configured to direct the flow of fluid from the chamber radially and rearwardly to contact the leading edge of the second blade.

13. The propeller of claim 1 wherein the number of blades is four, oriented symmetrically about the axis of rotation.

14. The propeller of claim 1 wherein the suction side is angled sufficiently to provide axial flow of the liquid when the propeller is rotated.

15. The propeller of claim 14 wherein the angle is between 5 degrees and 17 degrees from the said plane.

16. The propeller of claim 14 wherein the angle is about 6.95 degrees from the said plane.

17. The propeller of claim 14 wherein the angle of the suction side from the said plane is greater than the angle of the pressure side from the said plane wherein the pressure side is angled sufficiently to provide axial flow of the liquid when the propeller is rotated.

18. The propeller of claim 17 wherein the angle is between 1 degree and 10 degrees from the said plane.

19. The propeller of claim 17 wherein the angle is about 1.30 degrees from the said plane.

20. The propeller of claim 11 wherein the plane defined by the leading face is oriented generally parallel with the axis of rotation of the propeller.

21. The propeller of claim 20 wherein the plane defined by the trailing face is oriented generally parallel with the axis of rotation of the propeller.

22. The propeller of claim 1 wherein the width of the blade between the leading face and the trailing face at the tip is greater than the width of the blade between the leading face and the trailing face at the root section.

23. An submersible mixing propeller adapted to be rotated about a central axis, comprising:

(a) an intake;

(b) a plurality of hollow propeller blades radially extending outwardly from the central axis and connected to the intake, the propeller blades having a pressure side, suction side, tip, root section, leading face and a trailing face;

(c) the pressure side is oriented at an angle from a plane perpendicular to the axis of rotation in a direction toward the suction side when moving from the leading face to the trailing face;

(d) the suction side is oriented at an angle from a plane perpendicular to the axis of rotation in a direction toward the pressure side when moving from the leading face to the trailing face;

(e) a first discharge opening in the trailing face;

(f) a second discharge opening in the tip;

wherein the trailing face of a first blade is aligned generally in the same plane with the leading face of the second blade which follows the first blade such that when the propeller is rotated in use liquid exiting the discharge opening of the first blade is struck by the leading edge of the second blade;

and wherein the angled orientations of the pressure side and the suction side cause an axial flow of the water in which the propeller is submersed.

* * * * *